US005924932A

United States Patent [19]

Taylor

[11] Patent Number: 5,924,932

[45] Date of Patent: Jul. 20, 1999

[54] BALLISTIC IMPELLER GOLF CLUB

[75] Inventor: Roy H. Taylor, Fremont, Calif.

[73] Assignee: CenterFire Golf Corporation, Fremont, Calif.

[21] Appl. No.: 08/746,672

[22] Filed: Nov. 14, 1996

[51] Int. Cl.[6] ..... A63B 69/36

[52] U.S. Cl. ..... 473/131; 473/282

[58] Field of Search ..... 473/324, 329, 473/332, 333, 131, 282

[56] References Cited

U.S. PATENT DOCUMENTS

| | | | |
|---|---|---|---|
| 769,939 | 9/1904 | Clark . | |
| 1,739,467 | 12/1929 | Klutho . | |
| 4,170,357 | 10/1979 | Greer | 473/333 |
| 5,522,594 | 6/1996 | Taylor et al. | 473/131 |

FOREIGN PATENT DOCUMENTS

| | | |
|---|---|---|
| 1181539 | 6/1959 | France . |

OTHER PUBLICATIONS

Ahern, Gene, comic strip, *Times–Union*, p. 31 (Apr. 20, 1956).

*Primary Examiner*—William M. Pierce

*Attorney, Agent, or Firm*—Townsend, Townsend & Crew, LLP

[57] ABSTRACT

A golf club having a retractor system disposed in the club head. The retractor system may be pneumatic, which allows pressure from an expanding gas to alternatingly operate on opposite sides of a seal ring attached to a piston. The golf club includes a hollow shaft extending from one end and terminating in a club head. The club head includes a piston cylinder extending from a gas injection port terminating proximate to a front face of the club head. A feed chamber is disposed on each side of the piston cylinder, each of which is in fluid communication therewith. A piston is disposed within the cylinder and includes a ring seal at one end. The ring seal forms a fluid tight seal with the walls of the piston cylinder. A receptacle, adapted to provide a rapidly expanding gas, is disposed proximate to the injection port to direct expanding gas therethrough, moving the piston away from the injection port. Openings in the feed chambers are positioned in the piston cylinder to allow expanding gas exiting the injection port to travel through the club head and create a pressure differential in the cylinder so as to move the piston toward the injection port. Alternatively, a mechanical retractor may be employed that includes a flexible lanyard.

25 Claims, 10 Drawing Sheets

BALLISTIC IMPELLER GOLF CLUB

TECHNICAL FIELD

The present invention pertains to the field of golf clubs.

BACKGROUND ART

There are many types of golf clubs for directing a ball along the course of play. From a physics standpoint, clubs are used to impart a force upon the ball resulting from a transfer of kinetic energy from the club to the ball. The kinetic energy developed in the club results from a user standing upright, raising the club above the shoulder and swinging downward toward the ball, resting upon the ground or a tee. The amount of kinetic energy required is dependent upon the distance the ball must travel, which often varies. To that end, various clubs are available which enable a user to provide the requisite amount of kinetic energy to the ball. However, some distances often pose a significant challenge to certain individuals who might otherwise be capable of participating in golf. Many prior art attempts have been made to overcome this problem by amplifying the kinetic energy supplied by the club.

U.S. Pat. No. 769,939 to Clark discloses a golf club which uses a spring in a club head to add additional energy imparted by the club to a ball. The energy stored in the compressed spring is released by impact with the ball. In this manner, the ball travels further than the ball would otherwise travel if a conventional club is used. The practical success of this concept is limited since the peak energy release of the spring and contact with the ball must occur simultaneously, or precisely in phase, to achieve optimum results. Additionally, this design makes the club heavier, thereby increasing the difficulty of striking the ball accurately on the club's "sweet spot", which is more important than additional force in obtaining more distance.

French Pat. No. 1,181,539 to Celestin discloses a golf club which uses an explosive charge in a club head to add additional energy to the swing of the club. The club disclosed by Celestin is swung against the ball. The impact causes a piston having an attached firing pin to contact an explosive charge in the head of the club. The charge causes the piston to move outwardly toward the ball, impelling the ball away from the club. Again, the practical success of this concept is limited since the peak energy release of the explosive charge and contact with the ball must occur simultaneously, or precisely in phase, to achieve optimum results. Additionally, the "sweet spot" on the Celestin club is difficult to strike because the striking surface of the club is small and convex. Therefore, the accuracy of the club is likely to be very poor.

A drawback with the aforementioned devices is that each requires the user to swing the club, which results in a substantial amount of twisting motion on the spine. While such a motion is typically not difficult for a person in average health, or better, others may find the motion difficult, if not, debilitating.

A prior art attempt to impart kinetic energy upon a ball without swinging is disclosed in U.S. Pat. No. 5,522,594 to Taylor et al., which discloses a ballistic impeller golf club. The Taylor invention includes a golf club having a hollow head with a front face. An explosive charged is disposed in the hollow head. A strike plate is integrally formed with a piston. The front face includes an aperture through which the piston is received so that the strike plate rests against the front race in a retracted position. One end of a handle is attached to the club head, with the remaining end having a trigger mechanism attached thereto. A firing mechanism is disposed within the handle, with the trigger mechanism attached to one end and a firing pin attached to the remaining end. The firing pin is operably connected to the explosive charge. The charge is in fluid communication with the piston. Upon pulling the trigger mechanism, the firing pin strikes the charge, causing gases to expand within the head, pushing the piston outwardly. The kinetic energy of the expanding gas is imparted upon a ball resting in front of the strike plate. A retractor spring is connected to the piston to retract the same after the gases have exhausted from the head.

A drawback with the Taylor invention results from the tremendous forces that the retractor spring is subjected to, causing the same to deform and lose its resiliency. An object of the invention, therefore, is providing a ballistic impeller golf club having an improved retractor system.

Another object of the present invention is to provide a ballistic impeller golf club which is easily disassembled for cleaning in the field.

Yet another object of the present invention is to provide a ballistic impeller golf club that includes a safety system to prevent undesired or premature detonation of the charge.

SUMMARY OF THE INVENTION

The present invention features a golf club having a piston and a retractor system disposed in the club head that applies a force to the piston to retract the same after detonation of a charge, with the force applied being independent of a distance the piston has travelled. In one embodiment, the retractor system is pneumatic and uses pressure from an expanding gas to alternatingly operate on opposite sides of a moveable piston. In another embodiment, the retractor system is mechanical and employs a flexible lanyard attached to retract the piston upon the golf club being placed in a cocked position. The golf club includes a hollow shaft extending from one end and terminating in a club head. The club head includes a piston cylinder extending from a gas injection port, terminating proximate to a front face of the club head.

In the pneumatic retractor system, a feed chamber is disposed on each side of the piston cylinder and are each in fluid communication therewith. A piston is disposed within the cylinder and includes a ring seal at one end. The ring seal forms a fluid tight seal with the walls of the piston cylinder. A receptacle, adapted to provide a rapidly expanding gas, is disposed proximate to the injection port to direct expanding gas therethrough. Openings in the feed chambers are positioned in the piston cylinder to allow expanding gas exiting the injection port to travel through the club head and create is a pressure differential in the cylinder so as to move the piston toward the injection port.

In the preferred embodiment, a hollow piston is provided having a feed orifice at one end and an exhaust tube disposed at the opposing end, with a chamber disposed therebetween. The injection port is in fluid communication with the feed chambers when the piston is in the fully retracted position via the injection port and exhaust tubes and also the chamber. In an alternate embodiment, expanding gas enters each feed chamber after the piston has moved through the piston cylinder a predetermined distance. A tilt safety is also included to ensure gas expansion will not occur unless the handle forms an angle, with respect to a direction of gravity, that is within a predetermined range. Finally, a body is disposed within the head for rotational movement about an axis. The body includes a plurality of apertures in which a receptacle adapted to produce an expanding gas is disposed. Each aperture of the body is configured to be selectively placed into fluid communication with the injection port. A quick release mechanism is provided to allow quick field cleaning by the operator.

BEST MODE FOR CARRYING OUT THE INVENTION

Figure 1:
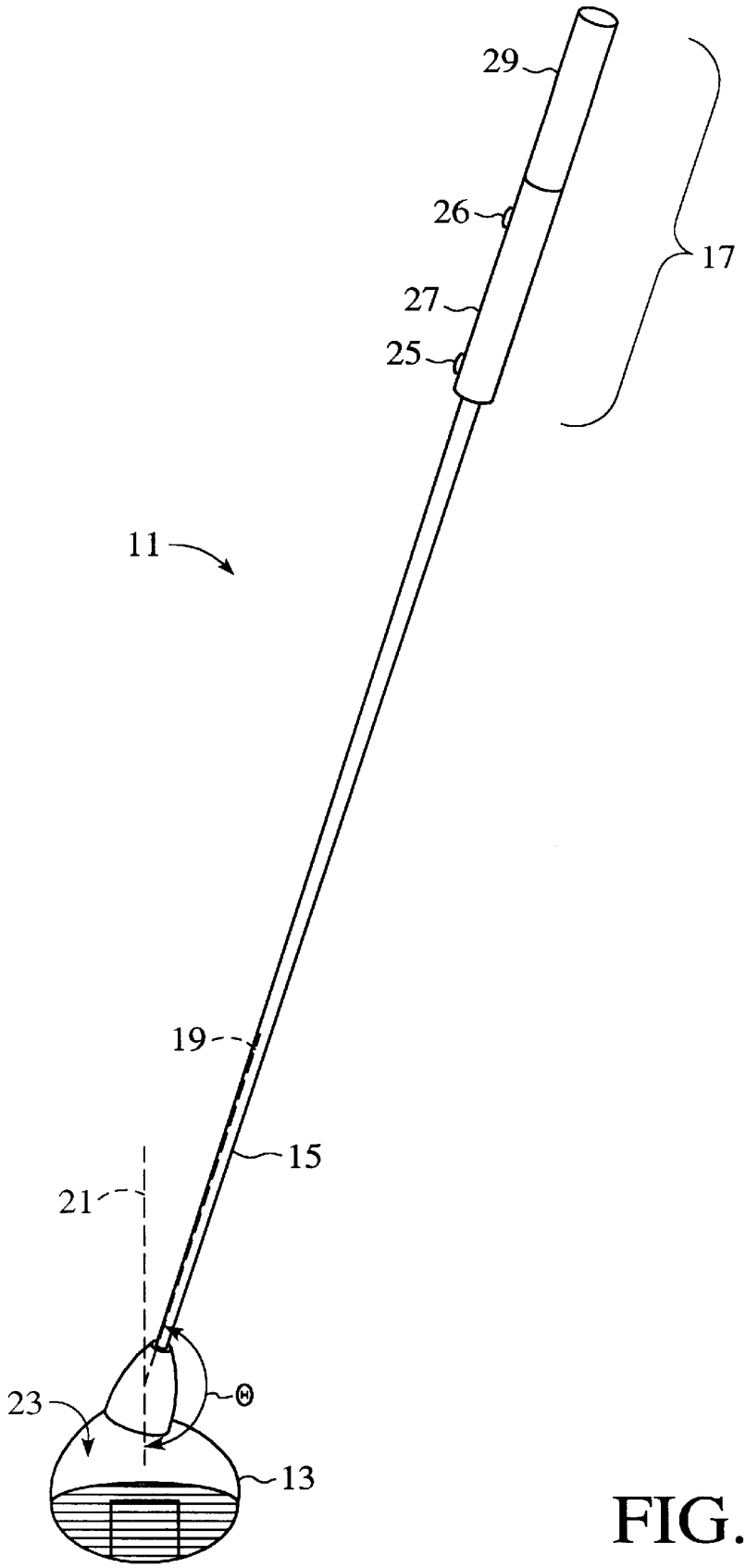
FIG. 1 is a perspective view of the present invention.

Referring to FIG. 1, a golf club 11 includes a club head 13 and a hollow shaft 15 extending from the club head 13, terminating in a handle assembly 17. Hollow shaft 15 includes a central axis 19 and extends from club head 13, with central axis 19 forming an angle Θ with respect to a vertical 21 to a top surface 23 of club head 13. Handle assembly 17 includes trigger 25 and safety 26 buttons, as well as rubberized sheaths 27 and 29.

Figure 2:
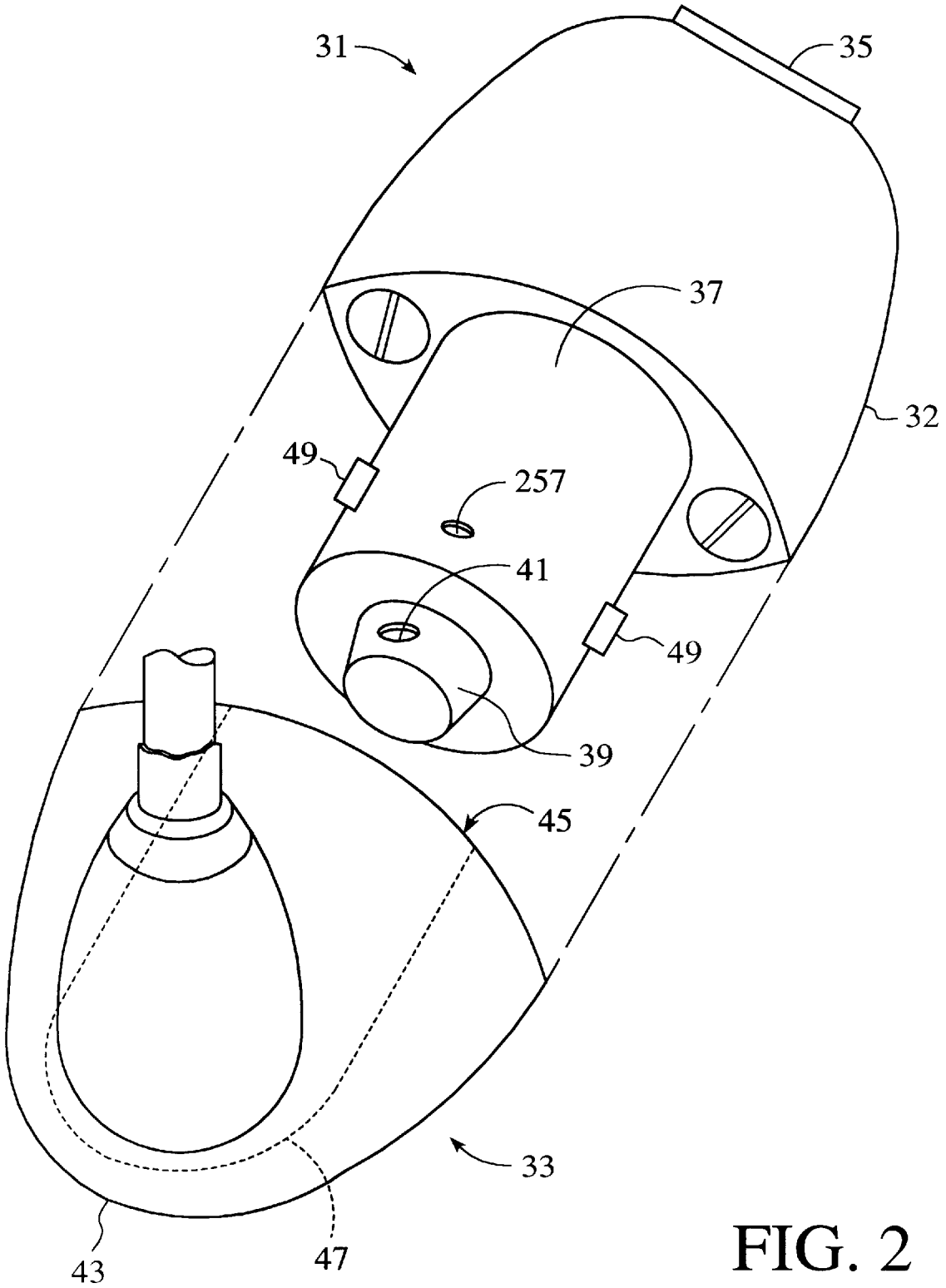
FIG. 2 is a exploded perspective view of the club head shown in FIG. 1, decoupled into a muzzle portion and a breech portion.
Figure 3:
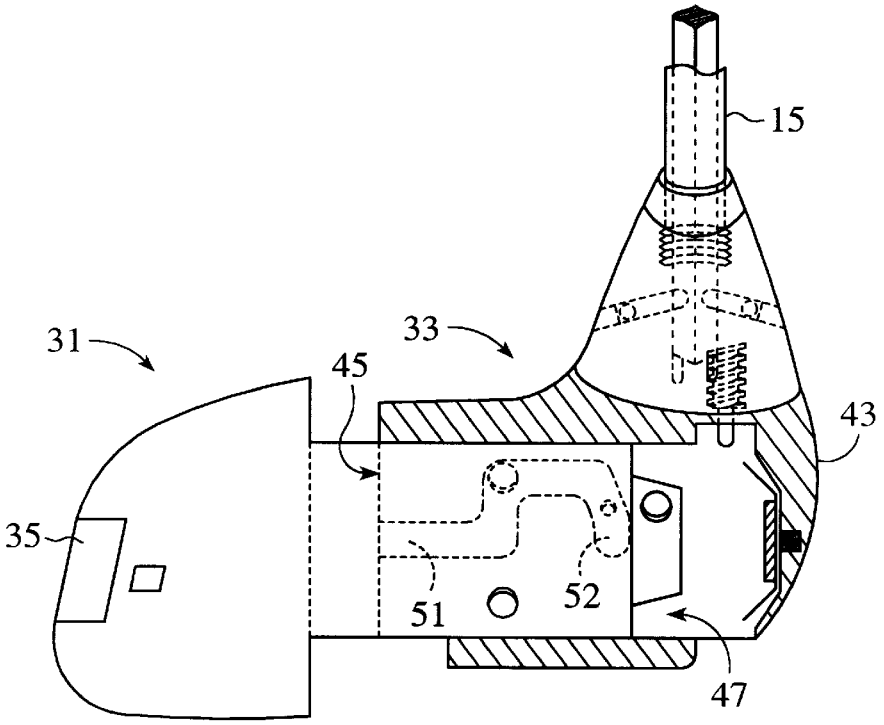
FIG. 3 is a side partial cross-sectional view of the club head with the breech portion for open loading of the club head.

Referring to FIGS. 1, 2 and 3, club head 13 is shown as having a muzzle portion 31 and a breech portion 33. Muzzle portion 31 includes a body 32 having a strike plate 35 disposed at one end, with a cylindrical housing 37 extending from the opposing end of muzzle portion 31, terminating in a tapered portion 39 having an injection port 41. Breech portion 33 extends from a closed end 43, terminating in an opening 45, defining a chamber 47. An end of hollow shaft 15, opposite to handle assembly 17, is attached to breech portion 33 proximate to closed end 43. Chamber 47 is adapted to encapsulate cylindrical housing 37. To securely affix muzzle portion 31 to breech portion 33, a pair of detents 49 extend from cylindrical housing 35. Chamber 47 includes complementary grooves, one of which is shown at 51 in which detents 49 are received when club head 13 is placed in a final seating position, shown more clearly in FIGS. 5 and 6.

Referring again to FIGS. 2 and 3, typically club head 13 is placed in the final seating position by aligning detents 49 with the complementary grooves 51 and rotating muzzle portion 31 ¼ revolution with respect to breech portion 33 until detents 49 rest against groove stop 52. Muzzle portion 31 may be decoupled from breech portion 33 by reversing the aforementioned procedure. This facilitates disassembling club head 13, which eases cleaning of the same, discussed more fully below.

Figure 4:
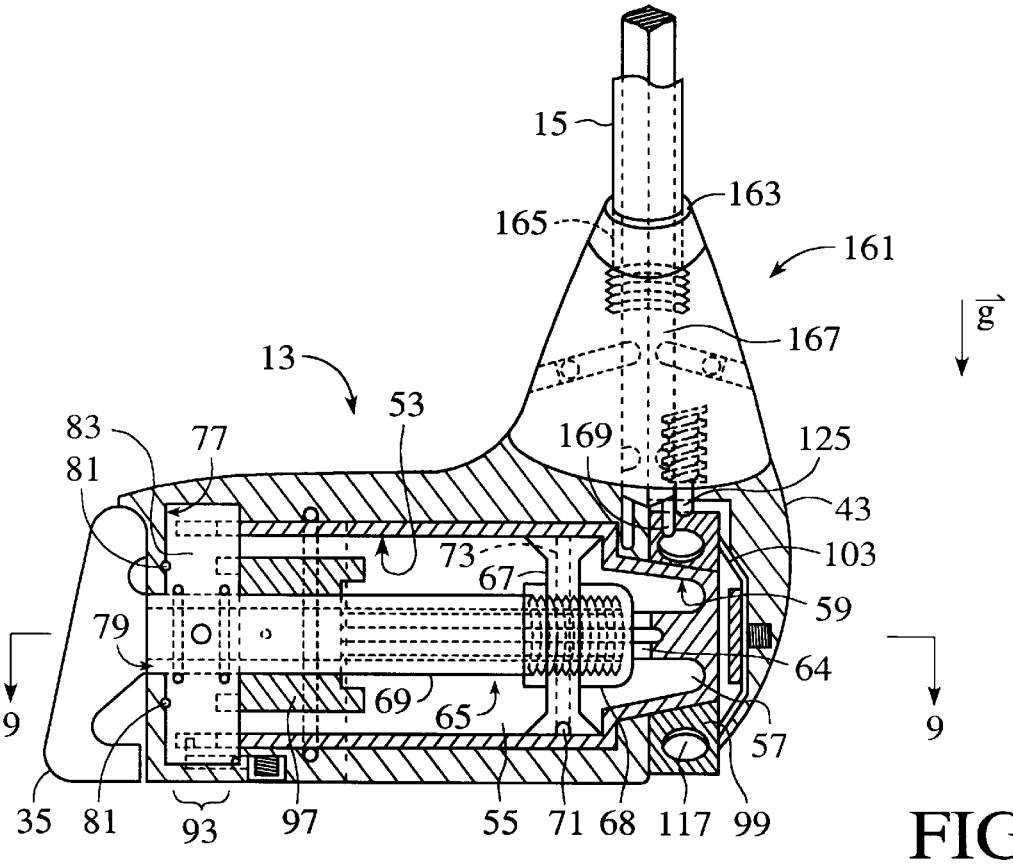
FIG. 4 is a side cross-sectional detailed view showing the internal mechanisms of the muzzle portion and the breech portion shown above in FIGS. 1–3.

Referring to FIGS. 2 and 4, club head 13 is shown in the final seating position, with an inner surface 53 of cylindrical housing 37 defining a piston cylinder 55. A blast chamber 57 is defined by an inner surface 59 of tapered portion 39, which places piston cylinder 55 in fluid communication with injection port 41. Piston cylinder 55 extends from blast chamber 57 and terminates in an orifice 61 which has a periphery including two latch members 63 protruding therefrom, seen more clearly in FIG. 5.

Referring again to FIG. 4, a radial orientation shaft 64 and a piston 65 are each disposed within piston cylinder 55. One end of shaft 64 is fixedly attached to an interior of tapered portion 39 and extends along a longitudinal axis of piston cylinder 55, with the remaining end floating free. Piston 65 includes a hollow chamber 66 through which shaft 64 passes, with piston 65 disposed about shaft 64 to move along the longitudinal axis of piston cylinder 55. Typically, shaft 64 extends through piston 65 the necessary distance to maintain mechanical connection with piston 65 during normal movement of piston 65 through piston cylinder 55. Piston 65 is disposed about shaft 64 to maintain a fixed radial orientation within piston cylinder 55. To that end, hollow chamber 66 has a cross-section complementary to the cross-section of shaft 64 with the aforementioned cross-sections being keyed so that piston 65 does not rotate about shaft 64.

Piston 65 includes a piston head 67, a starter head 68 and a piston rod 69. Piston rod 69 extends from piston head 67 and terminates in strike plate 35. Piston head 67 is positioned between starter head 68 and piston rod 69. Piston 65 is orientated within piston cylinder 55 so that piston head 67 is disposed between piston rod 69 and blast chamber 57. Piston head 67 typically has a shape complementary to the shape of piston cylinder 55. Piston head 67 is formed to provide a gas-check so that a fluid-tight seal is present between inner surface 37 and piston head 67. Strike plate 35 is attached to an end of piston rod 69 opposite to piston head 67. Although strike plate 35 may be attached to piston rod 69 with steel pins or screws (not shown), it is preferred that the two are integrally formed, with strike plate 35 forming an angle in the range of 10–30° with respect to a direction of gravity $\grave{g}$.

Figure 5:
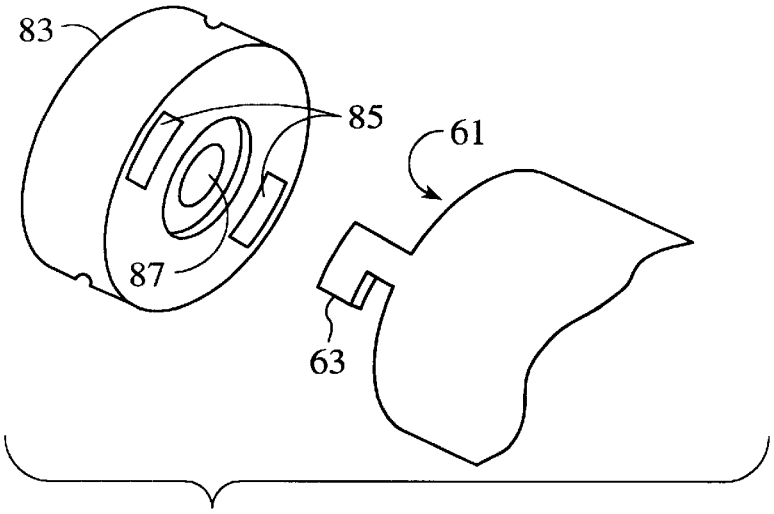
FIG. 5 is a detailed perspective view of a locking ring and latch members associated with the muzzle portion shown above in FIG. 4.
Figure 6:
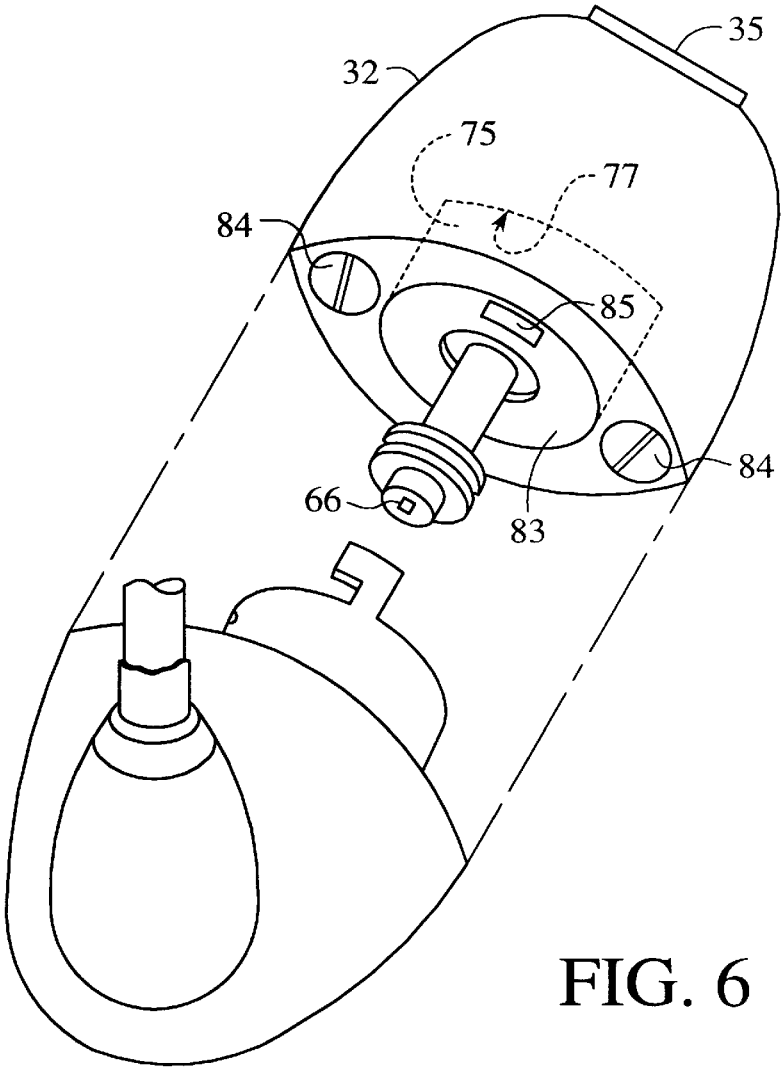
FIG. 6 is a exploded perspective view showing the decoupling of a cylindrical housing from the body of the muzzle portion shown above in FIGS. 4 and 5.
Figure 7:
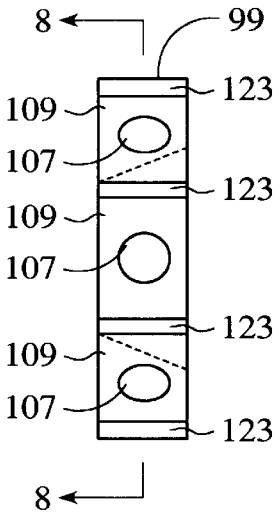
FIG. 7 is a side detailed view of a cartridge holder shown in FIG. 4.
Figure 8:
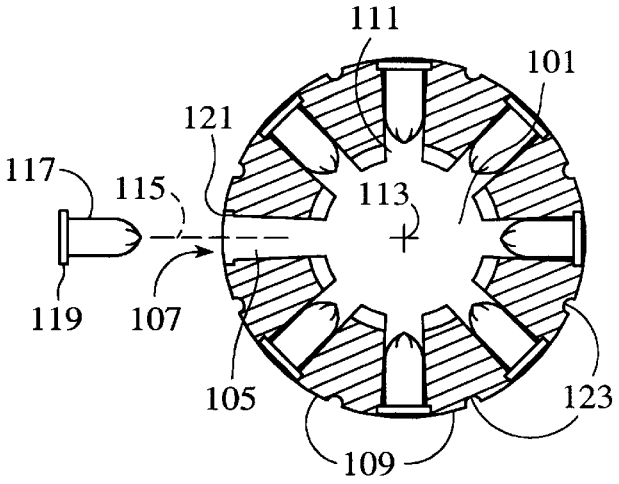
FIG. 8 is a cross-sectional view of the cartridge holder shown in FIG. 7, taken along lines 8—8.

Referring to FIGS. 4, 5 and 6, body 32 has a circular recess 75 with a first major surface 77. A passageway 79 extends from first major surface 77, terminating external to club head 13. A gasket 81 is disposed on first major surface 77, about the perimeter of passageway 79. A locking ring 83 is fixedly secured within recess 75 via screws 84, wedging gasket 81 against first major surface 77 forming a fluid-tight seal there-between. Locking ring 83 includes two or more spaced apart catch apertures 85, each of which is adapted to receive one of the latch members 63, and a central throughway 87 which aligns with passageway 79. Piston rod 69 passes through both throughway 87 and passageway 79, with strike plate 35 disposed on a side of body 32, opposite to locking ring 83. A sealing means 93 is disposed within throughway 87 to form a fluid tight seal between piston rod 69 and locking ring 83. Disposed within muzzle portion 31, about the perimeter of throughway 87, is a marshmallow spring 97. Marshmallow spring 97 extends from muzzle portion 31 into piston cylinder 55, with piston rod 69 passing through the marshmallow spring 97.

Cylindrical housing 37 is attached to body 32 by inserting latch members 63 into catch apertures 85 and rotating the cylindrical housing 37 and body 32 in opposite directions, thereby forming muzzle portion 31. An advantage with having a removable cylindrical housing 31 is that it facilitates cleaning of the golf club 11 in the field. Typically, the expanding gas employed leaves a residue that may cause the piston to bind after repeated use. This residue may be easily removed by decoupling the components for cleaning.

Referring to FIGS. 3, 4, 7 and 8, a rotor 99 is shown as configured to be disposed between piston cylinder 55 and closed end 43, when head 13 is in the final seating position. Specifically, rotor 99 includes a central cavity 101 which receives tapered portion 39. Rotor 99 is resiliently biased against tapered portion 39 by spring member 103 positioned on closed end 43. The position of rotor 99, with respect to tapered portion 39, is maintained by a spring member 103. Spring member 103 is mounted in a recess of chamber 47, located in closed end 43.

A plurality of ducts 105 extend from an opening 107 disposed in a periphery 109 of rotor 99, terminating in an orifice 111 proximate to central cavity 101. Each duct 105 tapers approximately 3° between opening 107 and orifice 111, with opening 107 having a greater area than orifice 111. Rotor 99 is radially symmetric about axis 113, with each of the ducts 105 having a longitudinal axis 115 extending transverse to axis 113. Each duct 105 is configured to receive a receptacle 117 adapted to produce a rapidly expanding gas. Although any type of rapidly expanding gas containing receptacle may be employed, it is preferred that receptacle 117 is a blank-charge of the type typically employed in blank-guns. Typically, receptacle 117 is a cartridge housing a smokeless powder and a primer. Receptacle 117 may be either rim fire or rimless fire. Receptacle 117 is disposed within a duct 105 so that a primer portion 119 of receptacle 117 is disposed proximate to periphery 109. Duct 105 includes a counter sunk portion 121 adapted to receive primer portion 119, with receptacle 117 mounting flush with respect to periphery 109. In this fashion, expanding gases from receptacle 117 are directed toward axis 113 upon detonation of receptacle 117.

Referring to FIGS. 1, 2, 4, 7 and 8, in the final seating position, rotor 99 is pivotally disposed about tapered portion 39 to rotate about axis 113. A portion of periphery 109 extends from breech portion 33, opposite hollow shaft 15, and is accessible to a user of golf club 11. Essential to the proper operation of golf club 11 is ensuring that each orifice 111 of rotor 99 is selectively aligned with injection port 41 so that a maximum quantity of expanding gas may pass therethrough into blast chamber 57. To that end, rotor 99 includes a plurality of dimples 123 positioned in periphery 109. Dimples 123 are arranged to form an interlocking fit with a plunger 125 located proximate to closed end 43, upon muzzle portion 31 and breech portion 33 being fixed in the final seating position.

Referring to FIGS. 2, 4, 7 and 8, plunger 125 is resiliently disposed to project toward dimples 123 and moves transverse to axis 113. In this fashion, rotor 99 may be pivoted by hand so that upon alignment of each orifice 111 with injection port 41, plunger 125 is received within a dimple 123 forming an interference fit therewith. When receptacle 117 is detonated to produce expanding gas, a great amount of pressure is developed in blast chamber 57 which projects piston head 67 toward locking ring 83, thereby moving strike plate 35 away from club head 13. Marshmallow spring 97 is adapted to decelerate piston head 67 upon impact.

Figure 9:
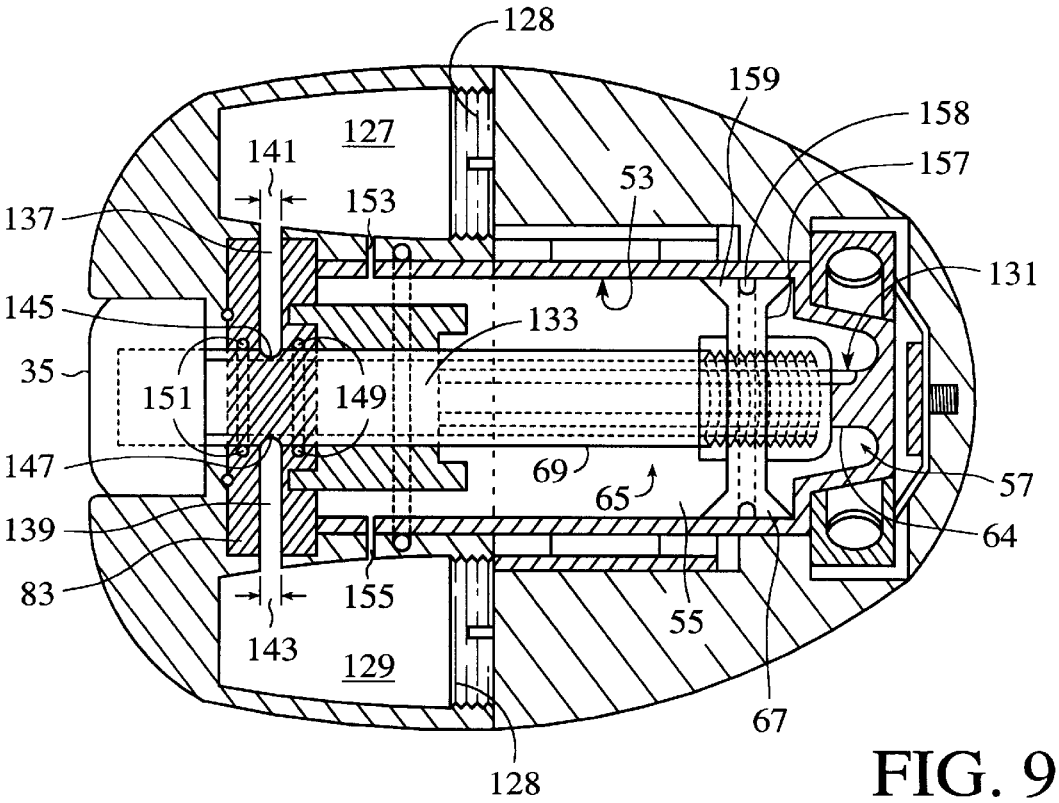
FIG. 9 is a bottom cross-sectional view of the club head shown in FIG. 4, taken along lines 9—9.

Referring also to FIGS. 5 and 9, piston 65 is returned to an initial seating position, with piston head 67 disposed proximate to blast chamber 57, by means of reverse pressurization. Specifically, a pressure reversing pneumatic retraction system is employed to return piston 65 to the initial seating position. The pneumatic retraction system includes two feed chambers 127 and 129, each of which is in fluid communication with blast chamber 57 by means of channel 131 in shaft 64 that is disposed in piston rod 69. Preferably, feed chambers 127 and 129 are integrally formed with body 32 of muzzle portion 31. One end of each chamber is sealed with a pressure cap 128. Feed chambers 127 and 129 are placed in opposing relation on opposite sides of piston cylinder 55, proximate to strike plate 35.

Shaft 64 includes a feed orifice 131 positioned proximate to blast chamber 57. A feed channel 133 is formed in piston rod 69 and is in fluid communication with feed orifice 131 located in shaft 64. Two inlet channels 137 and 139 are disposed in locking ring 83, with each inlet channel 137 and 139 extending through locking ring bearing 87, terminating proximate to a periphery of locking ring 83. Each inlet channel 137 and 139 is in fluid communication with a feed chamber 127 and 129 by a coupling tube 141 and 143, respectively. Feed channel 133 is in fluid communication with inlet channels 137 and 139 via outlet orifices 145 and 147, respectively.

As discussed above, locking ring 83 forms a fluid tight seal between piston rod 69 and locking ring 83 by having sealing means 93 attached thereto. Sealing means 93 includes a first gasket 149 and a second gasket 151. First gasket 149 forms a fluid-tight seal between piston cylinder 55 and inlet channels 137 and 139. Second gasket 151 forms a fluid-tight seal between an exterior of muzzle portion 31 and inlet channels 137 and 139.

In operation, high pressure expanding gas enters blast chamber 57 through injection port 41 and impinges upon starter head 68 and piston head 67. A portion of the gas entering blast chamber 57 passes through feed orifice 131 and into feed channel 133 via feed tube 135. Gas entering feed channel 133 passes through outlet orifices 145 and 147 and into feed chambers 127 and 129. Specifically, gas exiting through outlet orifice 145 passes into feed chamber 127 via inlet channel 137 and coupling tube 141; gas exiting through outlet orifice 147 passes into feed chamber 129 via inlet channel 139 and coupling tube 143. As piston head 67 moves toward marshmallow spring 97, fluid communication between outlet orifices 145 and 147 and inlet channels 137 and 139, respectively, terminates. This, in turn, terminates fluid communication between feed channel 133 and feed chambers 127 and 129. More particularly, an outer surface of piston rod 69 covers one end of inlet channels 137 and 139, with first and second gaskets 149 and 151 effectively sealing gas in feed chamber 127 and 129. Residual gas remaining in feed chamber 133 and piston cylinder 55 is vented into an ambient outside of club head 13, upon piston rod 69 extending away from muzzle portion 31 a sufficient distance to place outlet orifices 145 and 147 in fluid communication with the ambient. This creates a pressure differential within club head 13, with the gas pressure present in feed chambers 127 and 129 being greater than the gas pressure in piston cylinder 55.

To take advantage of the aforementioned pressure differential, outlet ports 153 and 155 place piston cylinder in fluid communication with feed chambers 127 and 129, respectively. Gas slowly bleeds through outlet ports 153 and 155, creating a pressure build up in the portion of piston cylinder 55 located between locking ring 83 and piston head 67. This returns piston 65 to the initial position, to begin a new cycle.

As discussed above, problems encountered with use of the aforementioned expanding gas concerns the build-up of residue on inner surface 53 which defines piston cylinder 55. To that end, it is preferred that piston head 67 is designed so that a central portion 157 of the same, proximate to shaft 64, be substantially thinner than a peripheral portion 159, positioned adjacent to inner surface 53. In this fashion, piston head 67 flares outwardly from central portion 157 toward peripheral portion 159, flexing outwardly toward inner surface 53 and forming a seal therewith. This shape creates a vortex which reduces the amount of residue that accumulates between piston head 67 and inner surface 53. Also, a gasket may be disposed within with a half-round groove 158 to form a fluid tight seal between inner surface 53 and piston head 67.

Referring to FIGS. 2, 3, 4 and 8, to detonate one of the receptacles 117, club head 13 also includes a firing pin housing 161 protruding upwardly and slightly outwardly from breech portion 33 opposite to rotor 99, tapering to form a firing pin housing tip 163. A bore 165 extends from pin housing tip 163, terminating proximate to tapered portion 39. A firing index pin 167 is disposed within bore 165 and includes a firing pin 169. Firing pin 169 extends adjacent to plunger 125 and is aligned with one of the receptacles 117 disposed in rotor 99 when plunger 125 is received within one of the dimples 123, as discussed above. Bore 165 is of sufficient size to restrict the movement of index pin 167 to axial motion parallel to an axis of bore 165. Bore 165 may have any cross-section desired, including hexagonal circular or rectangular, with index pin 167 having a complementary shape.

Referring to FIGS. 4, 10, 11, and 12, elongated hollow shaft 15 is fixed at an end of club head 13 opposite to handle assembly 17. Handle assembly 17 includes forward section 171, a rear section 173 and a spring channel 175 running the length of section 171, with rear section 173, which is smaller in diameter than forward section 171, fitting therein. Forward section 171 of handle 17 includes a trigger and safety groove 177, with safety groove 177 having trigger spring slot 179 and trigger slot 181. Rear section 173 includes forward cocking pawl slot 183, and rear cocking pawl slot 185. The diameter of spring channel 175 abruptly narrows, forming firing pin linkage spring shoulder 187, then abruptly widens again, resuming its previous diameter. Firing pin linkage 189 is slidably received in a cylinder 191 and coupled to firing index pin 167. Firing pin linkage 189 is attached to a trigger shoulder 193 and firing pin head 195, each having a larger diameter than firing pin linkage 189. A helical compression firing pin spring 197 is engaged over and around firing pin linkage 189 having one end engaged with trigger shoulder 193 and the other engaged with both a flat washer 199 and an end of firing pin spring housing 175.

Rear section 173 is slidably received in cocking handle sleeve 201. Forward cocking pawl 203 is slidably received in rear member section 173, with forward cocking pawl tab 207 extending through forward cocking pawl slot 183 and attached to cocking handle sleeve 201 by screws 213. Rear cocking pawl 209 is shaped substantially similar to forward cocking pawl 203, having rear cocking pawl tab 211. Rear cocking pawl 209 is slidably received in rear member section 173, with rear cocking pawl tab 211 extending through rear cocking pawl slot 185. Forward cocking pawl 203 and rear cocking pawl 209 are fixed to cocking handle sleeve 201 by means of cocking pawl screws 213. A helical compression cocking handle return spring 215 is received within handle housing 175, with one end engaged with a rear wall 217 of rear section 173 and the other engaged with rear cocking pawl 209. Cocking handle return spring 215 need not be fixedly attached to rear wall 217 of handle or with rear cocking pawl 209, because its inherent spring energy will tend to keep it engaged with these members.

Rubberized sheaths 27 and 29 cover forward member section 171 and cocking handle sleeve 201, respectively, and butt together. Sheath 27 has a hole 219 through which trigger button 25 extends, as well as a slot 221 through which safety button 26 extends.

Trigger mechanism 223 includes trigger member 225 having trigger button 25 attached to the upper surface at the forward end of trigger member 225 and pivot pin 227 which passes through trigger member 225 defining a pivot point. Trigger member 225 is arched slightly so that trigger member lever end 229 engages trigger shoulder 193. Each side of trigger pivot pin 227 is received in pivot holes 231 forward section 171. A helical trigger compression spring 233 is engaged with hollow shaft 15 at one end, with the remaining end engaging trigger member 225 in substantial proximity to trigger button 25.

A trigger safety mechanism 235 comprises safety member 237 having attached safety slide button 26, and helical safety return spring 239. Safety return spring 239 engages a safety pin 241, at one end, and snap ring 243 at the remaining end. Alternatively, safety return spring 239 is in a bore of safety member 237, with one end of spring 239 engaging a dead end of bore and the remaining end engaging a groove (not shown) in forward section 171.

In cocked position, trigger member lever end 229 is engaged with trigger shoulder 193. Safety member 237 engages trigger member lever 229, preventing release of trigger shoulder 193 and consequently release of firing pin linkage 189.

The firing mechanism is cocked by pulling cocking handle sleeve 201 back away from club head 13. This causes forward cocking pawl 203 to engage firing pin head 195, pulling firing pin linkage 189 away from club head 13 and, therefore, firing index pin 167. Firing pin linkage is moved until trigger shoulder 193 passes trigger member lever end 229. Trigger member lever end 229 is urged downwardly against firing linkage 189 by trigger compression spring 233. Safety member 237 is pushed forward to engage trigger member lever 229, preventing release of trigger shoulder 193. Cocking handle return spring 215 urges cocking handle sleeve 201 back to ready position. In this manner, the compressed springs store potential energy. The potential energy is converted to kinetic energy upon release of safety mechanism 235 and operation of trigger mechanism 223, which causes both the firing pin linkage 189 and the firing index pin 167 to move toward club head 13. In this fashion, firing pin 169 strikes receptacle 117, causing the same to detonate.

Figure 13:
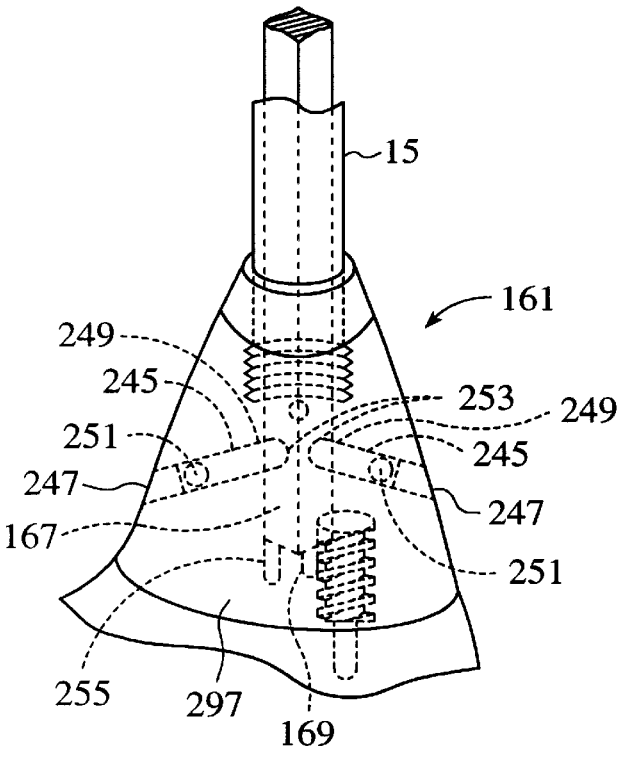
FIG. 13 is a cross-sectional view of a handle-club head interface showing a tilt-safety system, in accord with the present invention.

Referring to FIGS. 4 and 13, although it is not necessary, a tilt safety system is shown as being included in firing pin housing 161. The tilt safety system includes a plurality of bearing races 245 integrally formed with housing 161. Preferably, four races 245 are employed each extending from handle 15 angled toward club head 13 forming an angle Φ with respect to a direction of gravity. Angle Φ is typically in the range of 5 to 15°. In this fashion, each race 245 includes a nadir 247 and an apex 249. Each race 245 forms a 90° angle with respect to an adjacent race 245. A bearing 251 is disposed in each race 245 to rotate between nadir 247 and apex 249. Associated with each race 245 is an indent 253 formed in firing index pin 167. Each indent 253 is adapted to receive one of the bearings 251 so that the two hemispheres of one of the bearings 251 simultaneously contacts firing index pin 167 and apex 249 when the angle Φ is between 5 to 15°. The number of bearings 251 that are received within indents 253, at any one point in time, is dependent upon tilt direction and degree of angle. In this fashion, each bearing 251 forms an interlocking feature having an interference fit between firing pin housing 161 and firing index pin 167, thereby preventing the movement of firing pin 169. The tilt safety system is effective in preventing unintended detonation of receptacle 117 when golf club 11 is carried, for example, over a user's shoulder or when held upside down. To remove bearing 251 from indent 253 rear section 173 is pulled away from club head 13 to re-cock firing pin 169.

Referring to FIGS. 2, 4 and 13, an additional safety is provided to ensure detonation of receptacle 117 will not occur unless club head 13 is in the final seating position. To that end, a safety pin 255 is attached to firing index pin 167, extending past firing pin 169. A passage 257 is formed in the cylindrical housing so as to receive safety pin 255 upon muzzle portion 31 and breech portion 33 reaching the final seating position. If safety pin 255 fails to seat in passage 257 due, for example, to misalignment of muzzle portion 31 with respect to breech portion 33, safety pin 255, being longer than firing pin 169, acts as a stand-off. This causes firing pin 169 to fall short of receptacle 117, thereby preventing detonation of the same.

Figure 14:
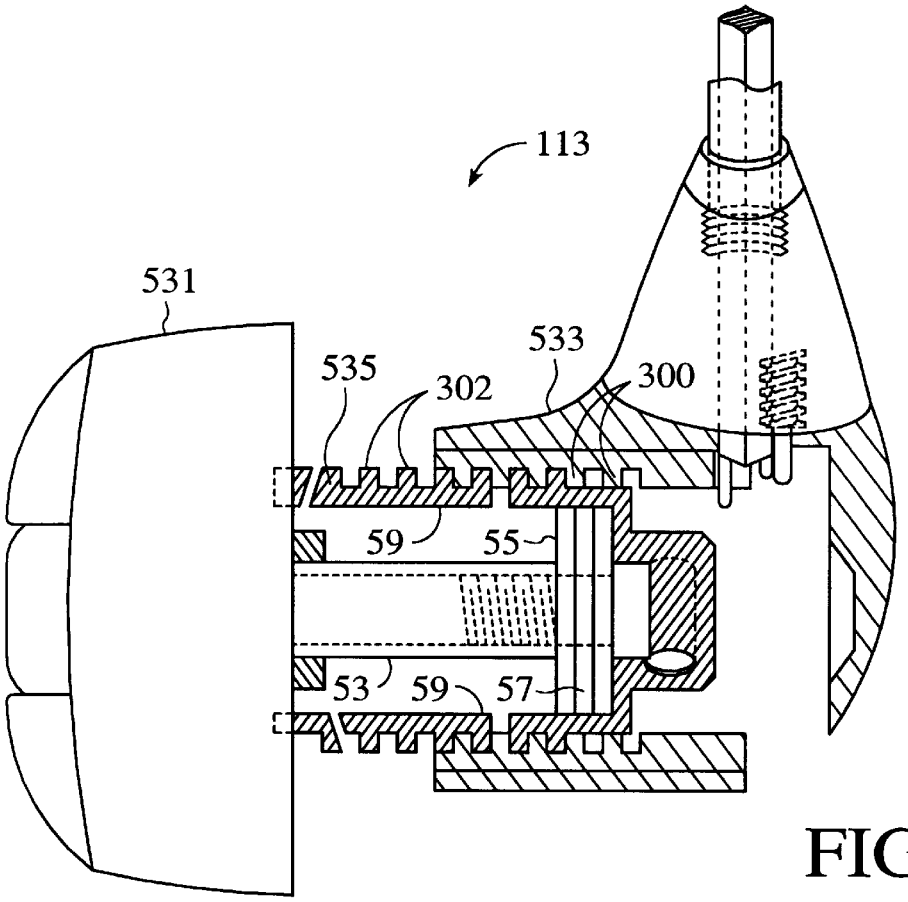
FIG. 14 is an exploded side cross-sectional view of the club head in accord with an alternate embodiment of the present invention.

Referring to FIG. 14, an alternate embodiment of club head 113 has the features mentioned above with respect to FIGS. 1–13 except that an interior surface of chamber 547, formed in breech portion 533, includes a plurality of threads 300. The outer surface of cylindrical housing 535 of muzzle portion 531 includes a plurality of threads 302 which are adapted to engage threads 300 of chamber 547.

Figure 15:
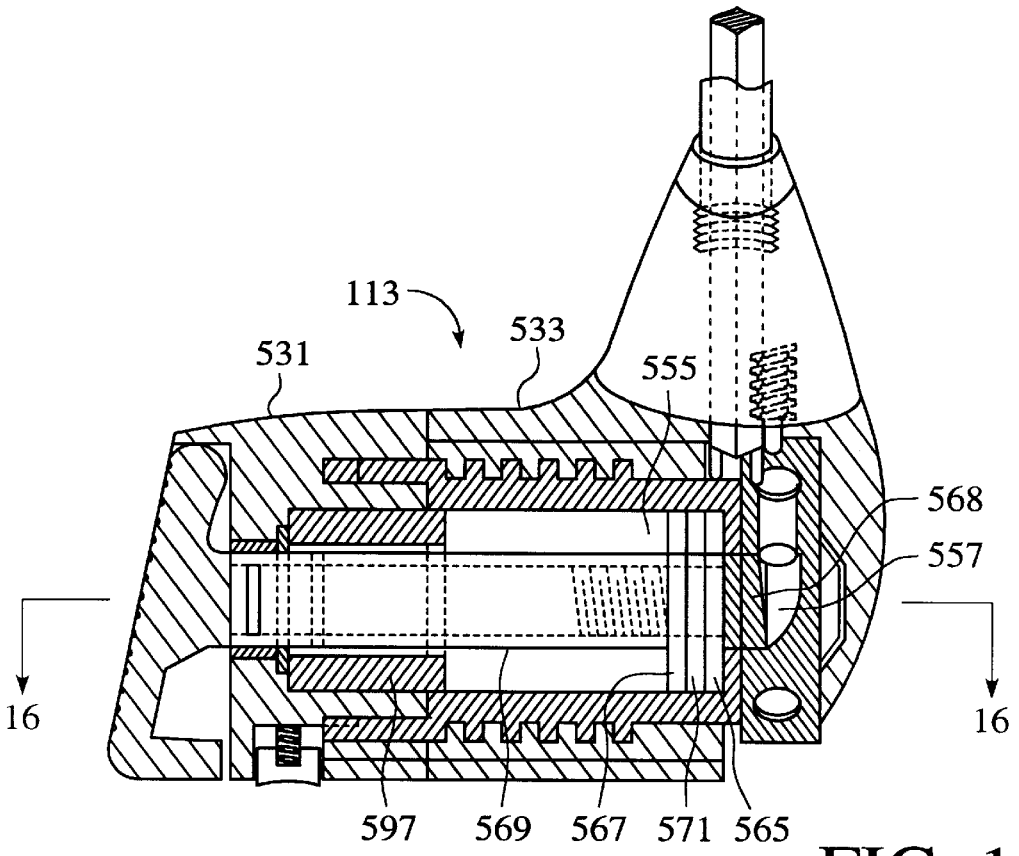
FIG. 15 is a side cross-sectional view of the club head shown in FIG. 14 in a closed position.
Figure 16:
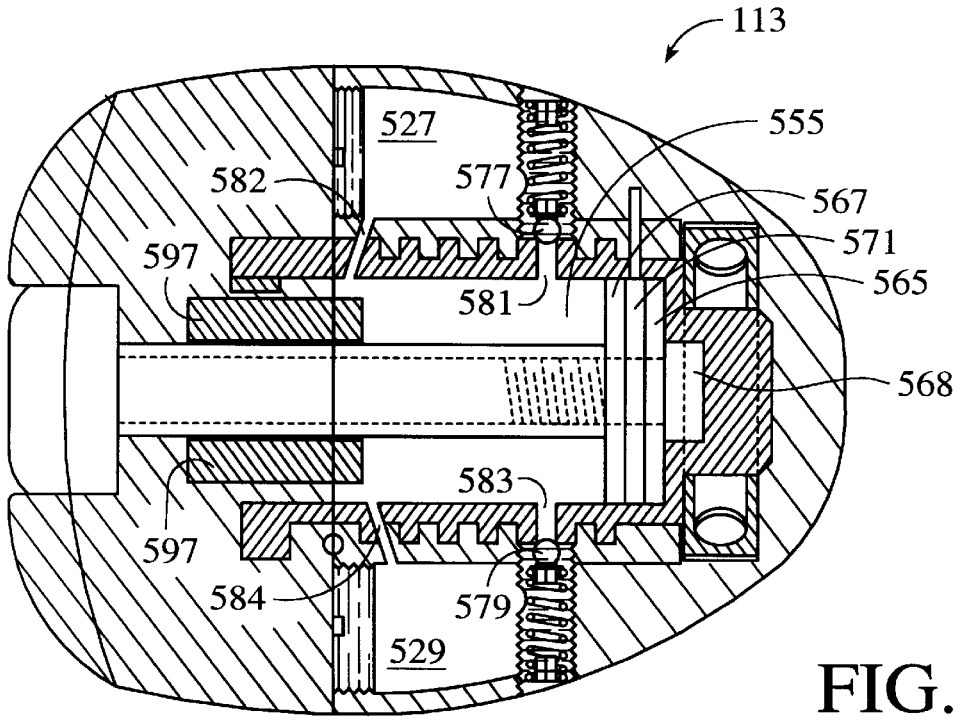
FIG. 16 is a bottom cross-sectional view of the club head shown in FIG. 15, taken along lines 16—16.

Referring to FIGS. 15 and 16, club head 113 is shown with muzzle portion 531 and breech portion 533 in a final seating position. Disposed within piston cylinder 555 is a piston 565 having a piston head 567, starter head 568 and a piston rod 569 which are orientated as discussed above with respect to FIGS. 1–13. Piston head 567 includes a half-round groove 571 circumferentially disposed thereabout. A gasket, such as an O-ring, may be disposed within groove, defining a sealing member. Sealing member has a shape matching a cross-section of piston cylinder 555 to form a fluid tight seal with between piston head 567 and the interior surface of chamber 555.

The retraction system in club head 113 differs from that shown above in that feed chambers 527 and 529 are selectively placed in fluid communication with piston cylinder 555 via check valves 577 and 579. Specifically, feed chamber 527 is selectively placed in fluid communication with piston cylinder 555 via feed channel 581 through check valve 577. Spaced apart from feed channel 581, is an outlet channel 582 placing feed chamber 527 in constant fluid communication with piston cylinder 555. Feed chamber 529 is selectively place in fluid communication with piston cylinder 555 via feed channel 583 through check valve 579. Spaced apart from feed channel 583, is an outlet channel 584 placing feed chamber 529 in constant fluid communication with piston cylinder 555.

During operation, the fluid pressure within piston cylinder 555 and feed chambers 527 and 529 is at equilibrium, with check valves 577 and 579 blocking fluid flow through feed channels 581 and 583, respectively. Upon detonation of receptacle 517, an expanding gas enters blast chamber 557. The expanding gas in blast chamber 557 creates pressure which operates on starter head 568 and piston head 567 causing both to travel away from blast chamber 557 toward marshmallow spring 597. As piston head 567 travels past feed channels 581 and 583, the pressure differential between piston cylinder 555 and feed chambers 527 and 529 causes check valves 577 and 579 to open. The opening of check valves 577 and 579 allows gas to travel from piston cylinder 555 to feed chambers 527 and 529. Upon piston head 567 impacting with marshmallow spring 597, a reverse pressure differential develops with the pressure present in feed chambers 527 and 529 being greater than the pressure present in the portion of piston cylinder located between piston head 567 and blast chamber 557. The reverse pressure differential results from outlet channels 582 and 584 having a substantially smaller cross-sectional area than feed channels 581 and 583. The small cross sectional area allows the gas pressure present in feed chambers 527 and 529 to slowly bleed into the portion of piston cylinder 555 disposed between marshmallow spring 597 and piston rod 567, driving piston 557 to its final seating position.

Figure 17:
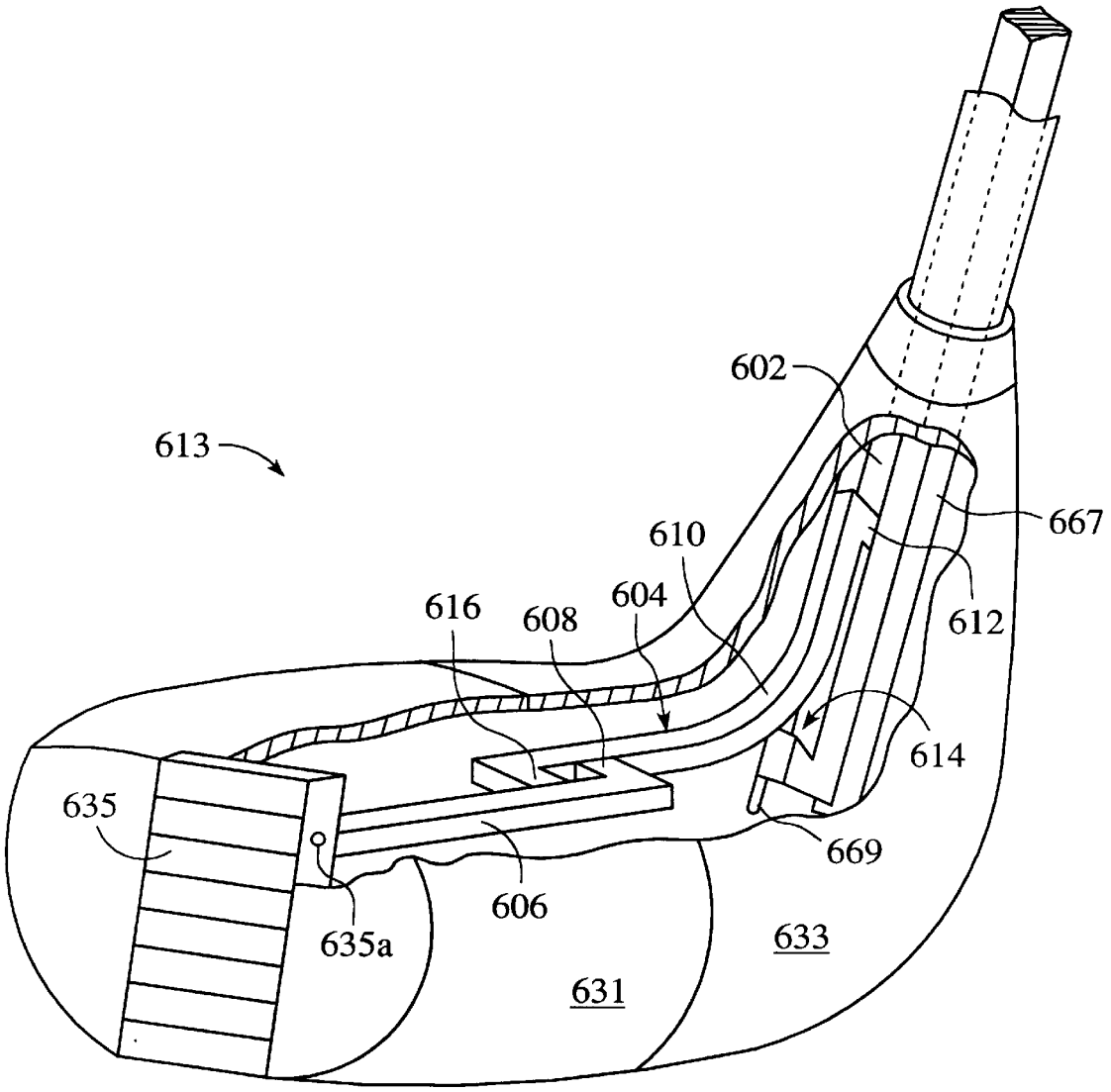
FIG. 17 is a perspective cut-away view of the club head in accord with a second alternative embodiment.
Figure 18:
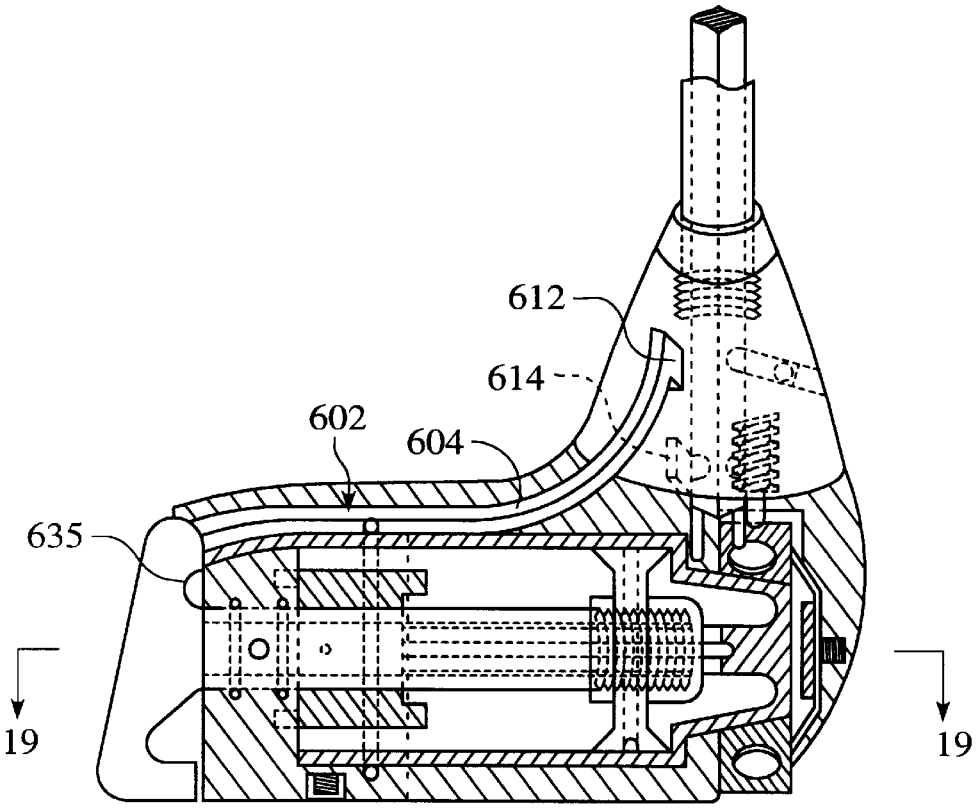
FIG. 18 is a cross-sectional side view of the club head shown in FIG. 17.

Referring to FIGS. 17 and 18, a third embodiment of the club head 613 is shown as including a passageway 602 disposed between the upper surface 623 and the piston cylinder 655. Disposed within passageway 602 is a flexible lanyard 604. A first section 606 of flexible lanyard 602 is coupled to strike plate 635 by a pin **635*a* and extends therefrom, terminating in a shoulder 608. A second section 610 of flexible lanyard extends from shoulder 608 and terminates in a dove-tailed groove 612, proximate to firing index pin 667. Firing index pin 667 includes a notch 614 having a shape complementary to the dove-tailed groove 612 and is disposed to receive the same and selectively form an interlocking fit therewith. The opposing end 616 of second section 610 includes a shoulder having a complementary shape to shoulder 608 with end 616 and shoulder 608** selectively forming an interlocking fit.

Figure 10:
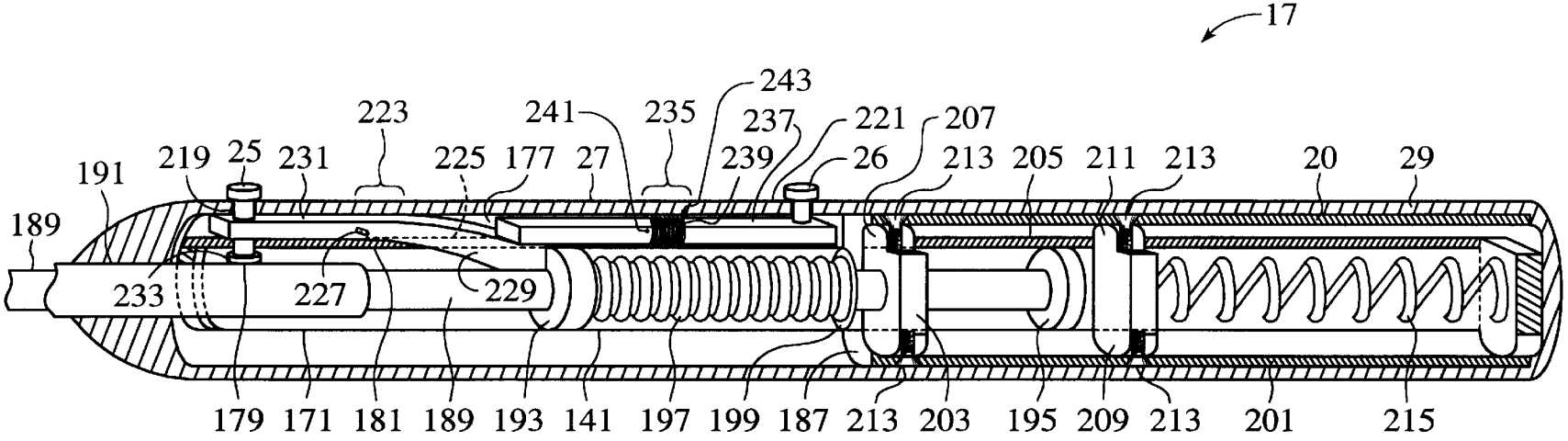
FIG. 10 shows a sectional perspective view of the handle shown in FIG. 1.
Figure 12:
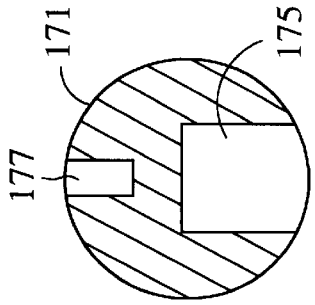
FIG. 12 is a front cut away view of the handle shown in FIG. 11, taken along lines 12—12.
Figure 11:
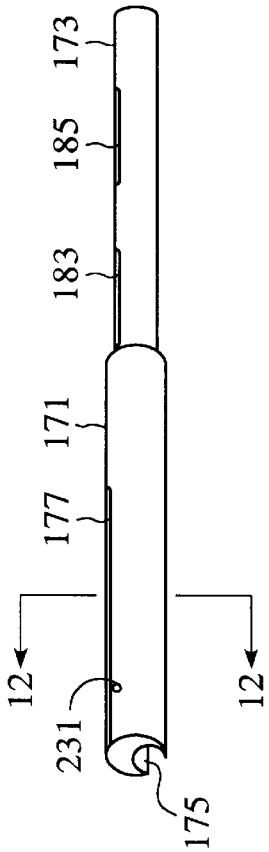
FIG. 11 is a perspective view of the handle shown in FIGS. 1 and 10.

Referring to FIGS. 10 and 17, in operation cocking handle sleeve 210 is pulled away from club head 613, causing rear cocking pawl 203 to slide against firing pin head 195. This causes firing pin linkage 189 and, therefore, firing index pin 667, to move away from club head 613. An interlocking fit between dove-tailed groove 612 and notch 614 causes second section 610 to move away from strike plate 635. This results in end 616 engaging shoulder 608 and moving first section 606 toward firing index pin 667. In this fashion, strike plate 635 is retracted into club head 613. Upon depressing trigger 25, the potential energy in spring 197 is converted to kinetic energy, driving firing pin 669 into receptacle (not shown). As the firing pin 669 thrusts forward into club head 613, the second section 610 is left in a retracted position. Upon detonation of the receptacle (not shown), strike-plate 635 is driven to its extended position. The interlocking fit of shoulder 608 with end 616 extends lanyard 604 into an extended position. In the extended position, dove-tailed groove 612 comes into contact with notch 614 so that strike-plate 635 may once again be placed in the retracted position, as discussed above.

Figure 19:
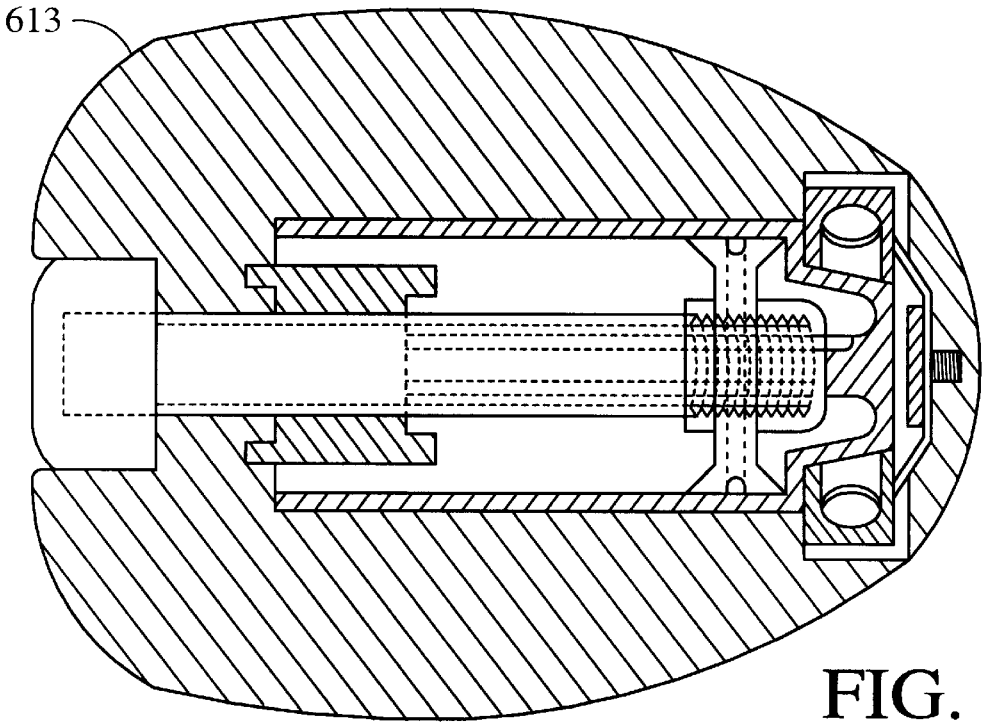
FIG. 19 is a bottom cross-sectional view of the club head shown in FIG. 18, taken along lines 19—19.

An advantage with employing lanyard 604 to retract strike-plate 635 is that club head 613 is of much simpler design, shown more clearly in FIG. 19. This lowers manufacturing costs, by abrogating the need to form the aforementioned channels and feed chambers associated with the pneumatic retraction systems, discussed above with respect to FIGS. 1–4, 9 and 14–16. Typically, club head 613 includes a muzzle portion 631 and a breech portion 633 that are coupled and decoupled as discussed above with respect to FIG. 3. To that end, breech portion 633 includes an annular groove 618 disposed so that shoulder 608 and a portion of first section 606 may travel therethrough until shoulder 608 lies in the same plane as end 612.

I claim:

1. A golf club, comprising:

a club head, said club head including a breech portion and a muzzle portion said muzzle portion having detents, said breech portion having complementary grooves for said detents, said muzzle portion rotatably attached to said breech portion, forming an interlocking fit therewith;

a handle attached to said club head;

storing means, coupled to said handle, for storing potential energy; and converting means, coupled to said club head, for converting said potential energy to kinetic energy.

2. The golf club as recited in claim 1 wherein said converting means includes a receptacle adapted to produce a rapidly expanding gas and further including a piston movably disposed in said club head for displacement along a first direction in response to said expanding gas, and means, in fluid communication with said piston, for pneumatically moving said piston along a second direction, opposite to said first direction.

3. The golf club as recited in claim 1 further including disabling means, attached to said club, for disabling operation of said converting means upon said handle, said handle forming an angle with respect to a direction of gravity, that falls within a predefined range.

4. The golf club as recited in claim 1 wherein said storing means includes a firing mechanism having a trigger assembly coupled to selectively compress and decompress a firing pin spring, whereby said spring stores potential energy when compressed and converts said potential energy to kinetic energy upon said spring decompressing.

5. The golf club as recited in claim 1 wherein said breech portion defines a chamber having walls and said muzzle portion includes a body adapted to fit within said chamber, with said body having a detent extending therefrom and said walls including a complementary groove adapted to receive said detent.

6. The golf club as recited in claim 5 wherein said groove extends along a path between an entrance recess and a stop, with said detent forming an interference fit with said stop upon reaching a final seating position therewith, thereby securely fastening together said breech portion and said muzzle portion.

7. The golf club as recited in claim 1 wherein said breech portion defines a chamber and said muzzle portion includes a body adapted to fit within said chamber, with said body having a cross-section with a shape complementary to a shape of a cross-section of said chamber.

8. A golf club, comprising:

a club head, said club head including a breech portion and a muzzle portion said muzzle portion having detents, said breech portion having complementary grooves for said detents, said muzzle portion rotatably attached to said breech portion, forming an interlocking fit therewith;

a handle attached to said club head;

storing means, coupled to said handle, for storing potential energy;

converting means, coupled to said club head, for converting said potential energy to kinetic energy; and a rotor disposed within an interior of said club head to rotate about an axis, said rotor being adapted to support a container that includes a charge to produce a rapidly expanding gas.

9. The golf club as recited in claim 8 further including a piston movably disposed within an interior of said club head for displacement along a first direction in response to said expanding gas and converting means, with said club head including an aperture extending from said interior, terminating proximate to an exterior of said head, with said piston extending therethrough from said interior, terminating in a strike plate disposed on said exterior.

10. The golf club as recited in claim 9 wherein said piston includes a hollow chamber.

11. The golf club as recited in claim 8 wherein said rotor is radially symmetric and includes a plurality of charges disposed therein.

12. The golf club as recited in claim 11 wherein said container is a blank cartridge.

13. The golf club as recited in claim 5, wherein said gas is in fluid communication with said piston to move said piston in a first direction along an axis and further comprising means coupled to said club head for applying a force to move said piston along a second direction, opposite to said first direction, with said force being independent of a distance said piston has travelled.

14. The golf club as recited in claim 1, wherein the club head further comprises a firing pin housing;

wherein said handle further comprises a longitudinal axis and a shaft disposed within said handle to move along a direction parallel to said longitudinal axis, said shaft having recess disposed therein, with said firing pin housing having a race disposed therein, one end of which extends from an opening positioned adjacent to said recess; and a bearing disposed within said race to move along a length thereof, with said recess and said bearing having dimension that allow a portion of said bearing to rest within said recess, forming an interference fit therebetween.

15. The golf club as recited in claim 14 wherein said race extends away from said handle forming an angle with respect to gravity.

16. The golf club as recited in claim 14 wherein said angle is in the range of 5° to 15° degrees.

17. The golf club as recited in claim 16 further including a plurality of races, each of which is uniquely associated with one of said plurality of recesses.

18. The golf club as recited in claim 14 wherein said shaft includes a plurality of recesses each of which is orientated 90° with respect to an adjacent recess.

19. A golf club, comprising:

a club head having a piston chamber and a piston disposed within said piston chamber, said piston being adapted for displacement along an axis, said club head including a breech portion and a muzzle portion said muzzle portion having detents, said breech portion having complementary grooves for said detents, said muzzle portion rotatable attached to said breech portion, forming an interlocking fit therewith;

a handle attached to said club head, said handle having a longitudinal axis;

a receptacle adapted to produce a rapidly expanding gas, with said receptacle being coupled to said club head and move said piston along a first direction; and a retraction system, coupled to said piston, to selectively apply a force to move said piston along a second direction, opposite to said first direction.

20. The golf club as recited in claim 19 wherein said retraction system includes a feed chamber disposed adjacent to said piston chamber and in fluid communication therewith via an outlet channel.

21. The golf club as recited in claim 20 wherein said inlet channel has a cross-sectional area which is greater than a cross-sectional area of said out let channel.

22. The golf club as recited in claim 19 further including an inlet channel extending between said feed chamber and said piston chamber, with a check valve disposed therein to selectively allow fluid communication between said piston chamber and said feed chamber through said feed channel.

23. The golf club as recited in claim 22 wherein said inlet channel has a cross-sectional area which is greater than a cross-sectional area of said outlet channel.

24. The golf club as recited in claim 19 further including an inlet channel extending between said feed chamber and said piston chamber, with said piston having a hollow interior extending between an aperture positioned proximate to said blast chamber and an opening positioned proximate to said inlet channel.

25. The golf club as recited in claim 19 further including an action, coupled to said handle, said action having a trigger assembly and a cocking assembly including a shaft disposed within said handle to move along a direction parallel to said longitudinal axis, wherein said retraction assembly includes a flexible lanyard coupled between said shaft and said piston.

* * * * *